US009611672B2

(12) United States Patent
Murphy

(10) Patent No.: US 9,611,672 B2
(45) Date of Patent: Apr. 4, 2017

(54) LOCK MECHANISM WITH EGRESS RELEASE

(71) Applicant: Schlage Lock Company LLC, Indianapolis, IN (US)

(72) Inventor: Nathanael Silas Murphy, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 303 days.

(21) Appl. No.: 14/325,283

(22) Filed: Jul. 7, 2014

(65) Prior Publication Data

US 2015/0013402 A1 Jan. 15, 2015

Related U.S. Application Data

(60) Provisional application No. 61/843,304, filed on Jul. 5, 2013.

(51) Int. Cl.
*E05B 3/00* (2006.01)
*E05B 15/00* (2006.01)
(Continued)

(52) U.S. Cl.
CPC ..... *E05B 15/0033* (2013.01); *E05B 3/00* (2013.01); *E05B 13/004* (2013.01);
(Continued)

(58) Field of Classification Search
CPC .... E05B 13/004; E05B 13/005; E05B 13/101; E05B 15/0033; E05B 55/005; E05B 63/0069; E05B 3/00; E05B 3/10; E05B 63/16; E05B 3/08; Y10S 292/37; Y10T 292/57; Y10T 292/93; Y10T 292/82; Y10T 292/85; Y10T 70/5372
(Continued)

(56) References Cited

U.S. PATENT DOCUMENTS 2,842,952 A * 7/1958 Russell ..... E05B 55/005 292/347
4,470,278 A * 9/1984 Hale ..... E05B 55/12 292/169.18

(Continued)

OTHER PUBLICATIONS

International Search Report and Written Opinion of the International Searching Authority; PCT/US2014/045623, Nov. 3, 2014; 10 pages.

(Continued)

*Primary Examiner* — Kristina Fulton
*Assistant Examiner* — Christine M Mills
(74) *Attorney, Agent, or Firm* — Taft Stettinius & Hollister LLP

(57) ABSTRACT

An exemplary lock includes an outer spindle, a center spindle, and a lock control assembly selectively coupling the outer and center spindles. In one embodiment, the lock control assembly includes a cam coupled to the center spindle, a locking bar slidingly coupled to the outer spindle, a cam follower positioned between the locking bar and the cam, and a biasing element urging the locking bar into engagement with the cam follower. Engagement between the cam and the cam follower may be configured to move the cam follower longitudinally in response to relative rotation between the cam and the cam follower.

25 Claims, 12 Drawing Sheets

(51) Int. Cl.

| | |
|---|---|
| ***E05B 63/16*** | (2006.01) |
| ***E05B 13/00*** | (2006.01) |
| ***E05B 63/00*** | (2006.01) |
| ***E05B 55/00*** | (2006.01) |
| ***E05B 13/10*** | (2006.01) |

(52) U.S. Cl.
CPC ..... *E05B 13/101* (2013.01); *E05B 55/005* (2013.01); *E05B 63/0069* (2013.01); *E05B 63/16* (2013.01); *Y10S 292/37* (2013.01); *Y10T 29/4984* (2015.01); *Y10T 29/49778* (2015.01); *Y10T 70/5372* (2015.04); *Y10T 292/57* (2015.04); *Y10T 292/82* (2015.04); *Y10T 292/85* (2015.04); *Y10T 292/93* (2015.04)

(58) Field of Classification Search
USPC ..... 292/347, 348, 358, 336.3, DIG. 37; 70/224
See application file for complete search history.

(56) References Cited

U.S. PATENT DOCUMENTS

| | | | | |
|---|---|---|---|---|
| 5,284,372 | A | 2/1994 | Lin | |
| 5,301,526 | A | 4/1994 | Fann et al. | |
| 5,372,025 | A | 12/1994 | Lin | |
| 5,657,653 | A | 8/1997 | Hensley et al. | |
| 5,784,909 | A * | 7/1998 | Huang | E05B 55/005 292/336.3 |
| 5,941,108 | A | 8/1999 | Shen | |
| 5,992,189 | A * | 11/1999 | McCaa | E05B 13/101 292/336.3 |
| 6,141,998 | A | 11/2000 | Seo | |
| 6,216,500 | B1 * | 4/2001 | Kang | E05B 13/10 292/336.3 |
| 6,351,976 | B1 * | 3/2002 | Chen | E05B 13/10 292/336.3 |
| 6,425,273 | B1 | 7/2002 | Kim et al. | |
| 6,615,630 | B2 | 9/2003 | Wu et al. | |
| 6,807,833 | B1 * | 10/2004 | Huang | E05B 13/101 70/107 |
| 6,993,945 | B1 | 2/2006 | Chen | |
| 7,100,407 | B2 * | 9/2006 | Chen | E05B 13/101 292/DIG. 27 |
| 7,559,219 | B2 * | 7/2009 | Chen | E05B 55/005 292/336.3 |
| 7,934,754 | B2 * | 5/2011 | Mathachan | E05B 13/002 292/336.3 |
| 8,479,544 | B2 * | 7/2013 | Liu | E05B 55/005 292/336.3 |
| 8,833,120 | B2 * | 9/2014 | Collins | E05B 55/005 292/336.3 |
| 9,284,749 | B2 * | 3/2016 | Vasudevan | E05B 55/005 |
| 2004/0237608 | A1 | 12/2004 | Chen | |
| 2009/0056391 | A1 | 3/2009 | Mathachan | |
| 2009/0056392 | A1 * | 3/2009 | Brannaman | E05B 17/005 70/91 |
| 2011/0185777 | A1 | 8/2011 | Zhang | |
| 2013/0233033 | A1 | 9/2013 | Collins et al. | |
| 2014/0191516 | A1 * | 7/2014 | Badhya | E05B 13/004 292/145 |

OTHER PUBLICATIONS

Canadian Office Action; Canadian Intellectual Property Office; Canadian Patent Application No. 2,917,486; Oct. 11, 2016; 5 pages.

* cited by examiner

LOCK MECHANISM WITH EGRESS RELEASE

CROSS REFERENCE TO RELATED APPLICATIONS

The present application claims the benefit of U.S. Provisional Application Ser. No. 61/843,304 filed Jul. 5, 2013, the contents of which are incorporated herein by reference in their entirety.

TECHNICAL FIELD

The present disclosure generally relates to door locks, and more particularly, but not exclusively, to tubular locks with egress release.

BACKGROUND

Tubular lock mechanisms are commonly used in securing doors. One embodiment of a tubular lock is disclosed in U.S. Pat. No. 4,470,278 to Hale, the contents of which are incorporated by reference in their entirety. Some tubular locks have certain limitations such as those relating to convenient control of the locked/unlocked state of the lock. Therefore, a need remains for further improvements in this field of technology.

SUMMARY

An exemplary lock includes an outer spindle, a center spindle, and a lock control assembly selectively coupling the outer and center spindles. In one embodiment, the lock control assembly includes a cam coupled to the center spindle, a locking bar slidingly coupled to the outer spindle, a cam follower positioned between the locking bar and the cam, and a biasing element urging the locking bar into engagement with the cam follower. Engagement between the cam and the cam follower may be configured to move the cam follower longitudinally in response to relative rotation between the cam and the cam follower. Further embodiments, forms, features, and aspects of the present application shall become apparent from the description and figures provided herewith.

DETAILED DESCRIPTION OF ILLUSTRATIVE EMBODIMENTS

Figure 1:
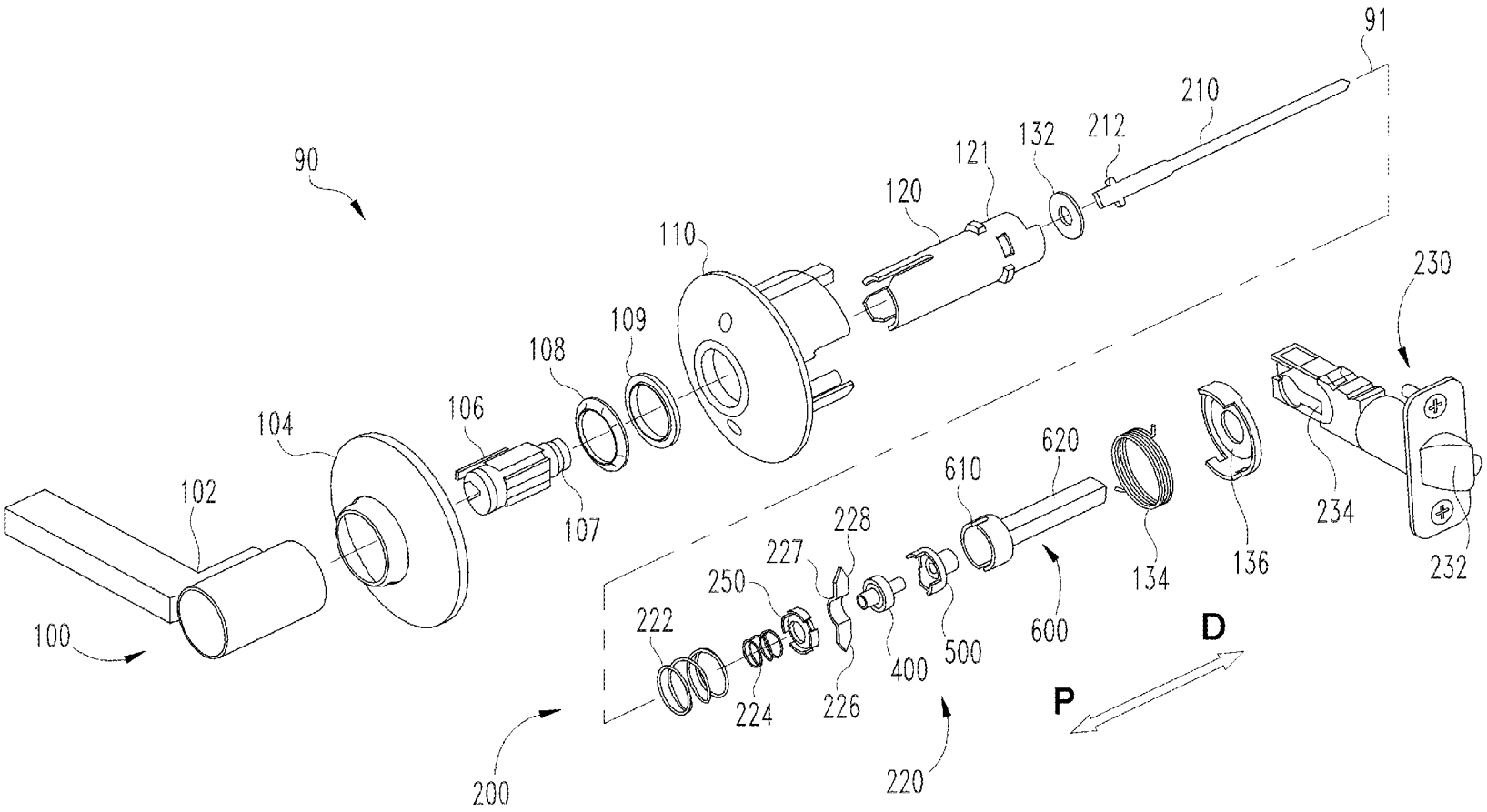
FIGS. 1 and 2 are exploded perspective illustrations of a tubular lock according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
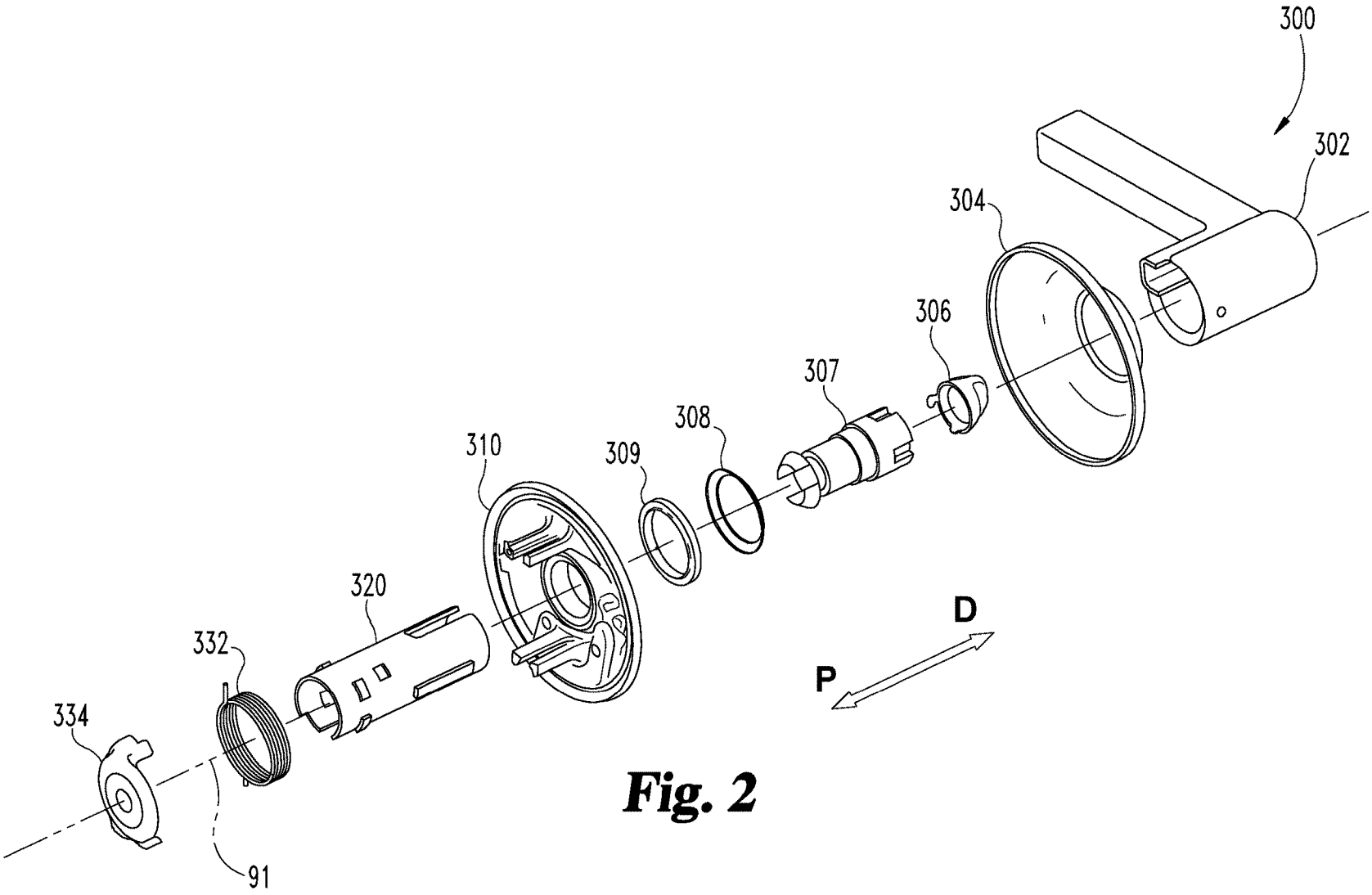

FIGS. 1 and 2 depict an illustrative tubular lock 90 including an outer assembly 100 mountable on an outer or unsecured side of a door (not illustrated), a center assembly 200 mountable in a cross-bore formed in the door, and an inner assembly 300 mountable on an inner or secured side of the door. When assembled, the center assembly 200 connects the outer and inner assemblies 100, 200, and the tubular lock 90 comprises a longitudinal axis 91 which extends in a proximal direction P and a distal direction D. As depicted in the Figures, the proximal direction extends from the secured side of the door toward the unsecured side of the door, and the distal direction extends from the unsecured side of the door toward the secured side of the door.

With reference to FIG. 1, the outer assembly 100 includes an outer lever 102, an outer rose 104, a lock cylinder 106 including a plug 107, an outer retaining ring 108, an outer retaining spacer 109, an outer housing 110 mountable on the outer side of the door (not illustrated), an outer spindle 120 rotationally coupled to the outer lever 102 and rotatably coupled to the outer housing 110, a stop washer 132 coupled to the outer spindle 120, an outer torsion spring 134 rotationally biasing the outer spindle 120 to a home position, and an outer spring plate 136.

The center assembly 200 includes a driver bar 210, a lock control assembly 220, a center spindle 600 including a cup 610 and a stem 620, and a latch mechanism 230 engaged with the stem 620. The driver bar 210 is connected to the plug 107 such as, for example, through a key cam (not illustrated) comprising a bowtie opening. The driver bar 210 rotates in response to rotation of the plug 107 through a predetermined angle. The illustrative lock control assembly 220 includes concentric first and second compression springs 222, 224, a detent cam 250, a locking bar 226, a cam follower 400, and a cam 500, with each of the listed elements positioned distally with respect to the previously-listed element. When assembled, the cam follower 400 and the cam 500 are at least partially received in the cup 610, and the cam 500 is rotationally coupled to the center spindle 600.

The first spring 222 is sandwiched between the stop washer 132 and the locking bar 226 such that the locking bar 226 is distally biased into engagement with the cam follower 400. The second spring 224 is sandwiched between a crossbar 212 on the driver bar 210 and the detent cam 250, such that the detent cam 250 is distally biased into engagement with the locking bar 226. The locking bar 226 includes an arcuate central portion 227 and a pair of arms 228 extending radially from the central portion 227. The latch mechanism 230 includes a latch bolt 232 and a retractor 234 engaged with the center spindle 600 such that the latch bolt 232 extends and retracts in response to rotation of the center spindle 600.

With reference to FIG. 2, the illustrative inner assembly 300 includes an inner lever 302, an inner rose 304, a turn button 306, a turn button coupler 307, an inner retaining ring 308, an inner retaining spacer 309, an inner housing 310, an inner spindle 320 rotationally coupled to the inner lever 302, an inner torsion spring 332 rotationally biasing the inner spindle 320 to a home position, and an inner spring plate 334. In the illustrated embodiment, the coupler 307 is configured to rotate the driver bar 210 in response to rotational motion of the turn button 306. It is also contemplated that the turn button 306 may be replaced by a push button (not illustrated), and the turn button coupler 307 may be replaced by a coupling cam operable to rotate the driver bar 210 in response to longitudinal movement of the push button.

When assembled, the inner spindle 320 is coupled to the center spindle 600 such as, for example, through the inner spring plate 334. When the tubular lock 90 is installed on a door, the outer surface of the door may abut the distal side of the outer housing 110, and the inner surface of the door may abut the proximal side of the inner housing 310. While the illustrated tubular lock 90 includes inner and outer levers 102, 302, it is also contemplated that one or both of the levers 102, 302 may be replaced with another form of a manual actuator such as, for example, a knob.

Figure 3:
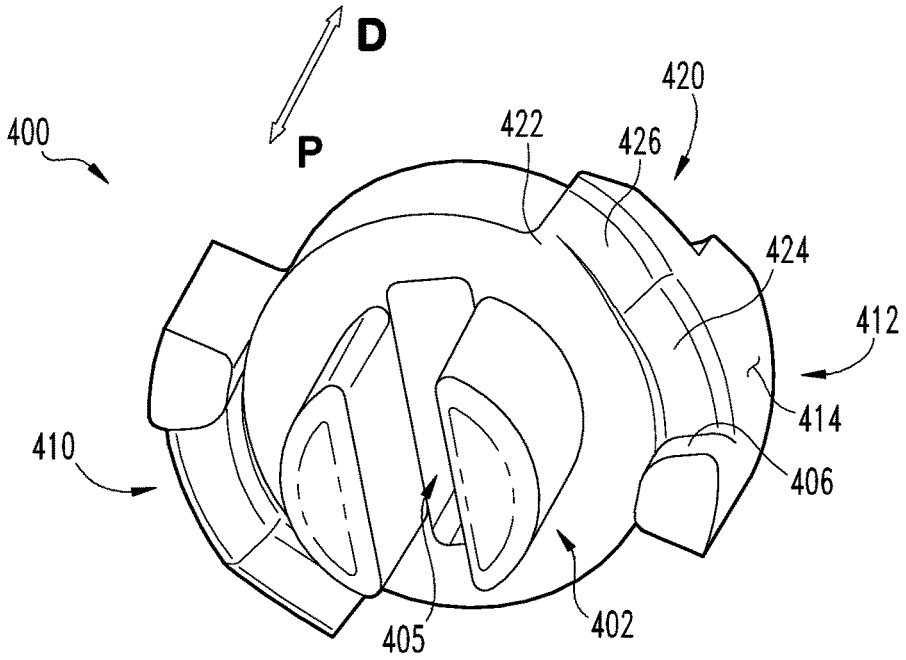
FIGS. 3 and 4 depict a cam follower according to one embodiment.
Figure 4:
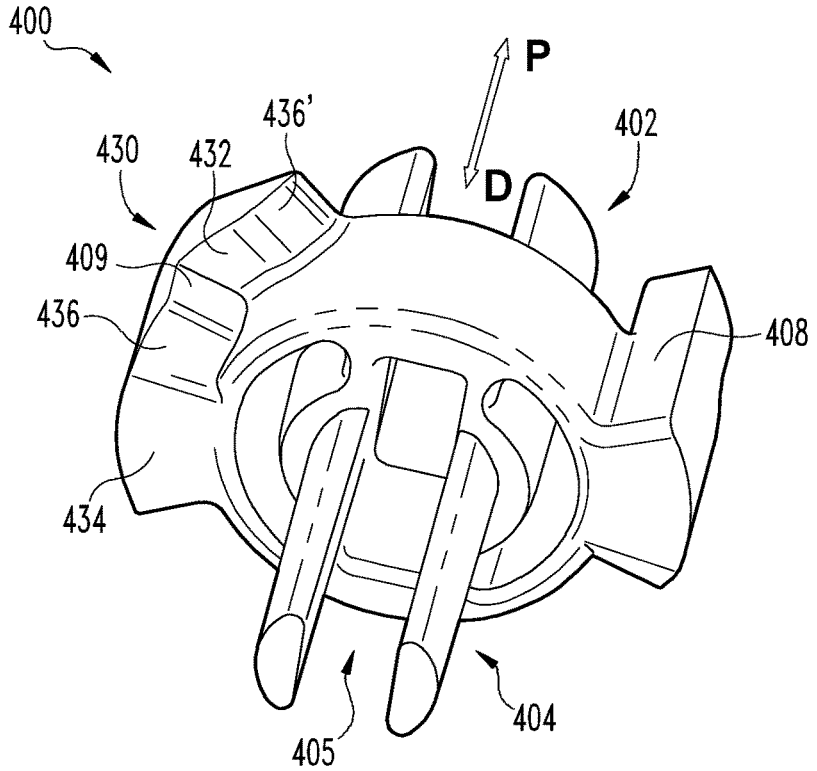

With additional reference to FIGS. 3 and 4, a cam follower 400 according to one embodiment includes a body 410, proximal and distal posts 402, 404 extending longitudinally from opposite sides of the body 410, and a slot 405 extending through the posts 402, 404 and the body 410. The posts 402, 404 are configured to maintain proper radial positions of various elements of the lock control assembly 220. When assembled, the proximal post 402 is received in the arcuate central portion 227 of the locking bar 226, the distal post 404 is received in an opening 502 (FIG. 5) within the fixed cam 500, and the driver bar 210 extends through the slot 405. The body 410 may include arcuate radial extensions 412, the outer surfaces 414 of which may slidingly engage the inner surface of the cup 610 to substantially prevent radial movement of the cam follower 400. The term "substantially" as used herein may be applied to modify a quantitative representation which could permissibly vary without resulting in a change in the basic function to which it is related. For example, the cam follower 400 may permissibly be capable of some radial movement if the operation of the lock control assembly 220 is not materially altered.

With the proximal post 402 received in the arcuate central portion 227, the cam follower 400 and locking bar 226 are rotatable and longitudinally movable with respect to one another, and the cam follower 400 substantially prevents radial movement of the locking bar 226. Similarly, with the distal post 404 received in the opening 502, the cam follower 400 is rotatable and longitudinally movable with respect to the cam 500, but the cam 500 substantially prevents radial movement of the cam follower 400. In certain embodiments, the distal post 404 may be omitted, and the radial positioning of the cam follower 400 may be performed by the engagement between the radially outer surfaces 414 and the cup 610. With the driver bar 210 extending through the slot 405, the cam follower 400 is rotationally coupled to the driver bar 210 and is axially movable with respect to the driver bar 210. In other words, the cam follower 400 rotates with the driver bar 210 and is free to slide longitudinally along the driver bar 210.

With reference to FIG. 3, the proximal side of the cam follower 400 includes a pair of positioning surfaces 420 operable to adjust the longitudinal position of the locking bar 226. Each positioning surface 420 includes a distal level 422, a proximal level 424, and a ramp 426 connecting the distal and proximal levels 422, 424. With the cam follower 400 positioned in a first rotational position, the distal side locking bar 226 engages the positioning surface distal level 422, thereby setting the locking bar 226 in a first longitudinal position. As the cam follower 400 rotates to a second rotational position, each of the arms 228 travels along one of the positioning surface ramps 426 and into contact with the corresponding positioning surface proximal level 424, thereby setting the locking bar 226 in a second longitudinal position. The cam follower 400 may further include one or more proximally extending stops 406 positioned adjacent the positioning surface proximal levels 424. In the second rotational position of the cam follower 400, the stops 406 may engage the arms 228, thereby limiting rotation of the cam follower 400 with respect to the locking bar 226.

With reference to FIG. 4, the distal side of the cam follower 400 includes a pair of first limit stops 408, a pair of second limit stops 409, and a pair of follower surfaces 430 operable to adjust the longitudinal position of the cam follower 400. Each follower surface 430 includes a distal level 434 positioned adjacent one of the first limit stops 408, and a ramp 436 extending proximally from the distal level 434 to one of the second limit stops 409. Each of the follower surfaces 430 may further include a proximal level 432 positioned adjacent one of the second limit stops 409 and a secondary ramp 436' extending proximally from the proximal level 432. Each pair of limit stops 408, 409 is engageable with the cam 500 to thereby limit relative rotation between the cam follower 400 and the cam 500.

In the illustrated embodiment of the cam follower 400, the stops 406, the first limit stops 408, and the second limit stops 409 are substantially parallel to the longitudinal axis 91. The positioning surface distal levels 422, the positioning surface proximal levels 424, the follower surface proximal levels 432, and the follower surface distal levels 434 are substantially perpendicular to the longitudinal axis 91, and are substantially parallel to the rotational plane of the cam follower 400. Additionally, each of the positioning surface ramps 426 and the follower surface ramps 436, 436' is offset at an oblique angle with respect to the longitudinal axis 91 such as, for example, by about 30°. However, in other embodiments, the above-described features of the cam follower 400 may define different angular orientations.

Figure 5:
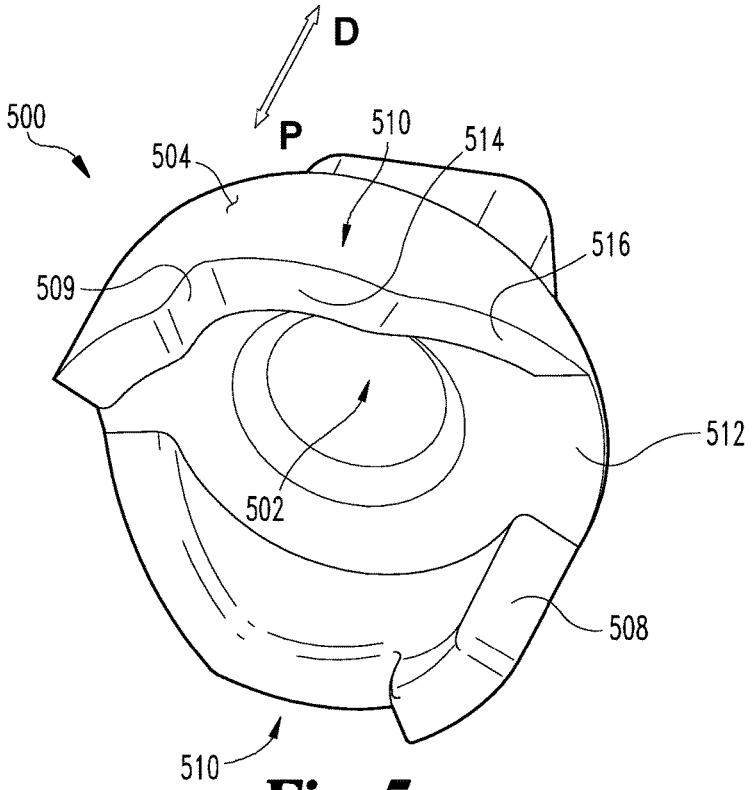
FIGS. 5 and 6 depict a cam according to one embodiment.
Figure 6:
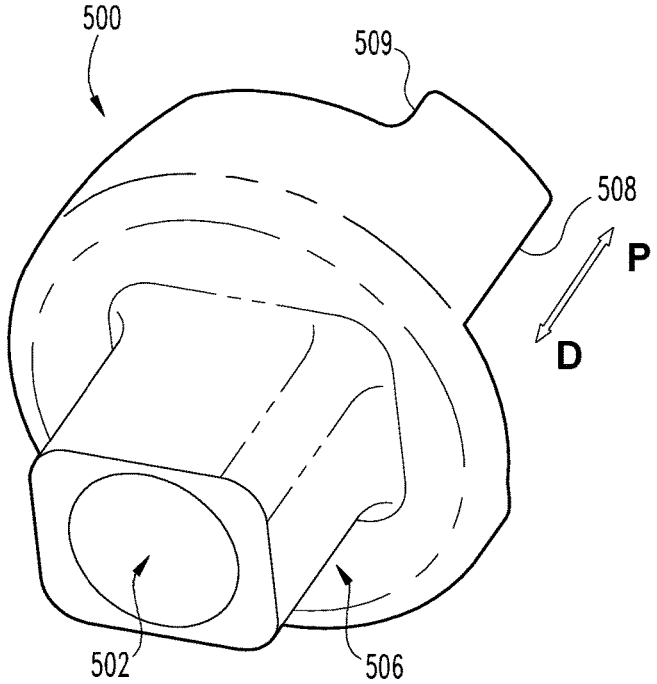

With reference to FIGS. 5 and 6, the cam 500 includes an opening 502 operable to receive the driver bar 210. In embodiments in which the cam follower 400 includes the distal post 404, the opening 502 may further be configured to receive the distal post 404. The cam 500 further includes a radially outer surface 504, which may define a radius corresponding to that of the radially inner surface of the cup 610, in order to radially locate and center the cam 500 with respect to the center spindle 600.

With specific reference to FIG. 5, the proximal side of the cam 500 includes a pair of cam surfaces 510, each of which engages one of the follower surfaces 430. Each of the cam surfaces 510 includes a distal level 512, a proximal level 514, and a ramp 516 connecting the distal and proximal levels 512, 514. As described in further detail below, engagement between the cam surfaces 510 and the follower surfaces 430 is configured to longitudinally move the cam follower 400 in response to relative rotation between the cam follower 400 and the cam 500. With specific reference to FIG. 6, the distal side of the illustrated cam 500 includes a protrusion 506 engageable with the center spindle 600 such that the cam 500 is rotationally coupled to the center spindle 600.

The cam 500 may further include a pair of proximally extending first stop walls 508 positioned adjacent the cam surface distal levels 512, and a pair of proximally extending second stop walls 509 positioned adjacent the cam surface proximal levels 514. The stop walls 508, 509 are configured to engage the cam follower 400 to limit relative rotation between the cam follower 400 and the cam 500. The pair of first of stop walls 508 is configured to engage the pair of first of limit stops 408 to thereby limit rotation of the cam follower 408 in a first rotational direction. The pair of second stop walls 509 is configured to engage the pair of second limit stops 409 to thereby limit rotation of the cam follower 400 in a second rotational direction.

In the illustrated embodiment of the cam 500, the first stop walls 508 and the second stop walls 509 are substantially parallel to the longitudinal axis 91. The follower surface distal levels 512 and the follower surface proximal levels 514 are substantially perpendicular to the longitudinal axis 91, and are substantially parallel to the rotational plane of the cam 500. Additionally, each of the cam surface ramps 516 is offset at an oblique angle with respect to the longitudinal axis 91, such as, for example, by about 30°. However, in other embodiments, the above-described features of the cam 500 may define different angular orientations.

Figure 7:
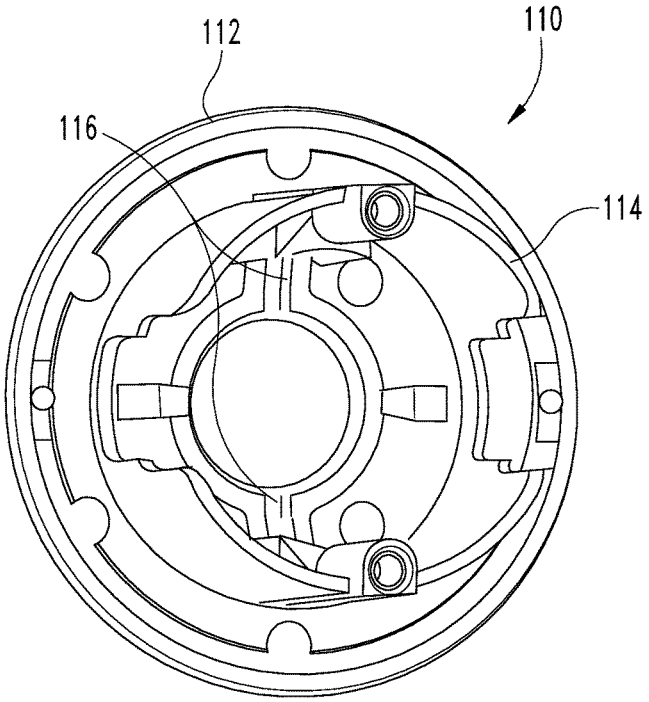
FIG. 7 depicts one embodiment of an outer housing.

With additional reference to FIG. 7, the exemplary outer housing 110 includes a radial flange 112 and a distally extending collar 114. When installed on a door (not illustrated), the flange 112 abuts an outer surface of the door, and the collar 114 is received in the cross-bore. The housing 110 further includes slots 116 sized and configured to receive the locking bar arms 228 when the tubular lock 90 is in a locked state.

Figure 8:
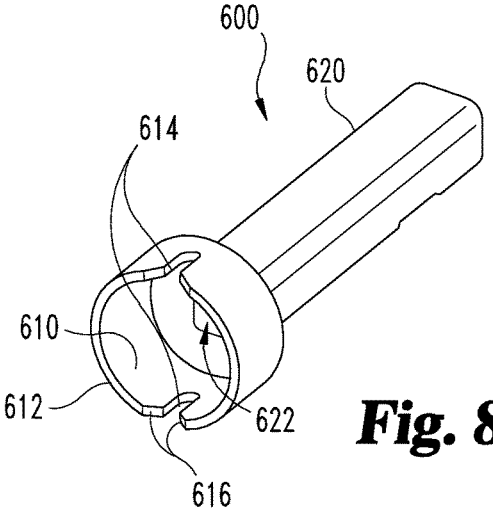
FIG. 8 depicts one embodiment of a center spindle.

With additional reference to FIG. 8, the center spindle 600 includes the cup 610 at its proximal end, and the stem 620 extends distally from the cup 610. The cup 610 is sized and configured to receive the cam follower 400 and the cam 500. The cup 610 includes a proximal end surface 612, and a pair of slots 614 extending distally from the proximal end surface 612. The slots 614 are sized and configured to receive the arms 228 of the locking bar 226 when the tubular lock 90 is in an unlocked state. The slots 614 may comprise chamfers 616 extending toward the proximal end surface 612.

The stem 620 includes a channel 622 sized and configured to receive the locking bar 210 such that the locking bar 210 is rotatable with respect to the center spindle 600. Additionally, the stem 620 is engaged with the retractor 234 such that the latch bolt 232 extends and retracts in response to rotation of the center spindle 600. The proximal end of the channel 622 may be sized and configured to receive the cam protrusion 506 such that the cam 500 is rotationally coupled with the center spindle 600. For example, the proximal end of the channel 622 may define a geometry corresponding to that of the protrusion 506. While other geometries are contemplated, in the illustrated embodiment, each of the protrusion 506 and the proximal end of the channel 622 comprises a substantially rectangular cross-section. Furthermore, while the cam 500 and center spindle 600 are illustrated as being distinct and separable elements, it is also contemplated that the cam 500 may be integrally formed with the center spindle 600 or securely coupled to the center spindle 600.

Figure 9:
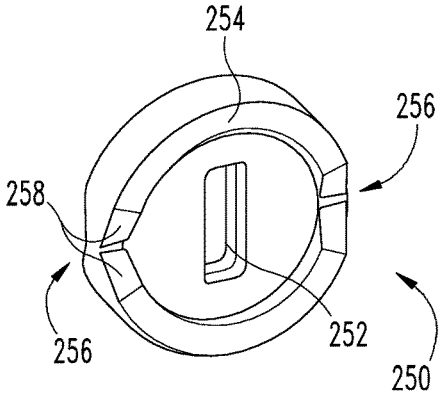
FIG. 9 depicts one embodiment of a detent cam.

With additional reference to FIG. 9, the detent cam 250 is provided with a slot 252 to receive the driver bar 210 such that detent cam 250 is rotationally coupled to the driver bar 210, and is longitudinally movable with respect to the driver bar 210. The distal side of the detent cam 250 includes a ridge 254 and a pair of notches 256 formed in the ridge 254, with each notch 256 including a pair of ramps 258 connected to the ridge 254. When assembled, the second spring 224 urges the detent cam 250 into contact with the locking bar 226. When the locking bar 226 is positioned in contact with the ridge 254, the detent cam 250, and thus the driver bar 210, is free to rotate. When the locking bar 226 is received in the notches 256, the arms 228 engage the ramps 258, thereby resisting rotation of the detent cam 250. In the illustrated embodiment, both the proximal and distal sides of the cam follower 250 include a ridge 254, notches 256, and ramps 258, wherein the detent cam 250 is reversible. It is also contemplated that only one side of the detent cam 250 need include the ridge 254, the notches 256, and the ramps 258.

Figure 10:
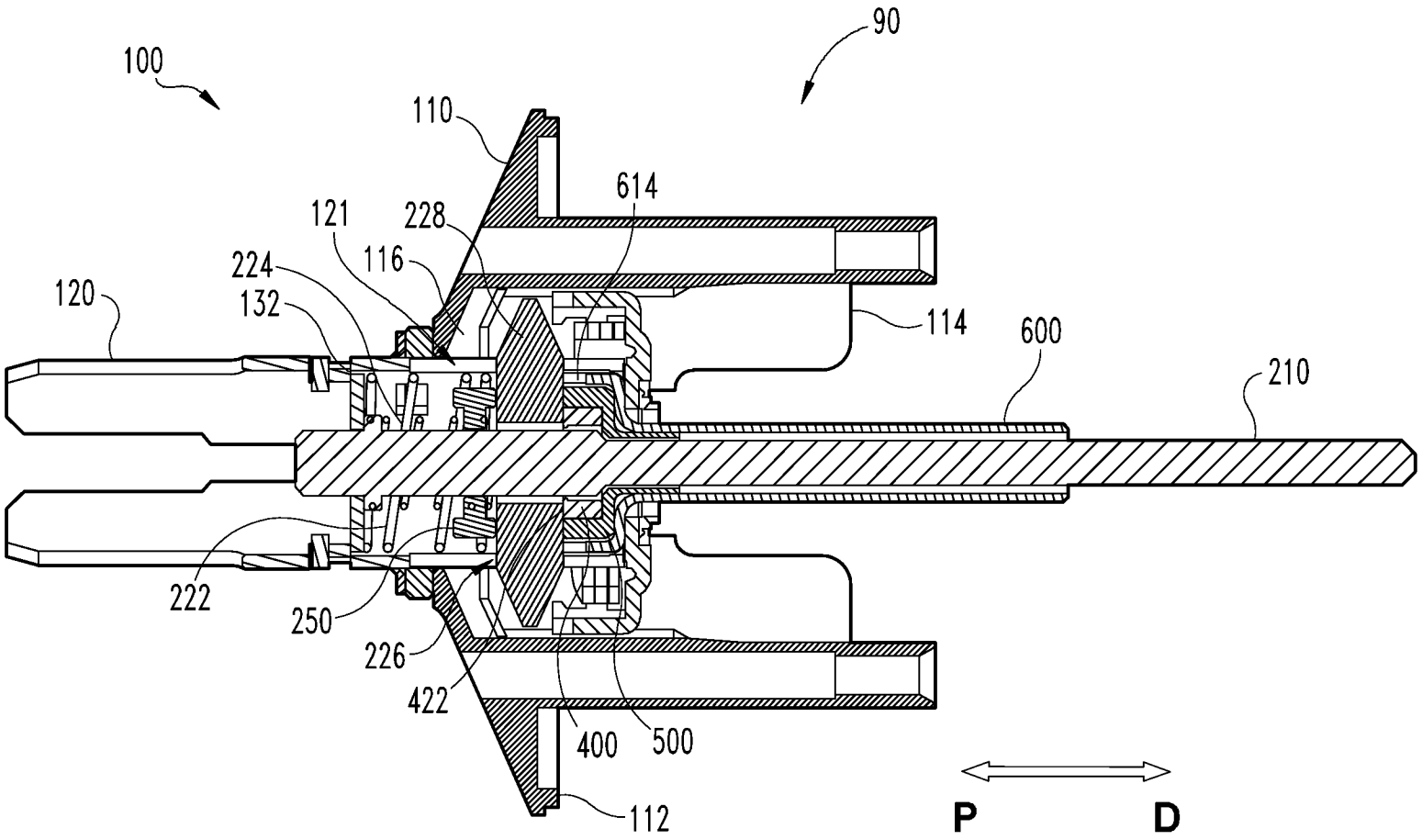
FIG. 10 is a cross-sectional illustration of the tubular lock in an unlocked state.
Figure 11:
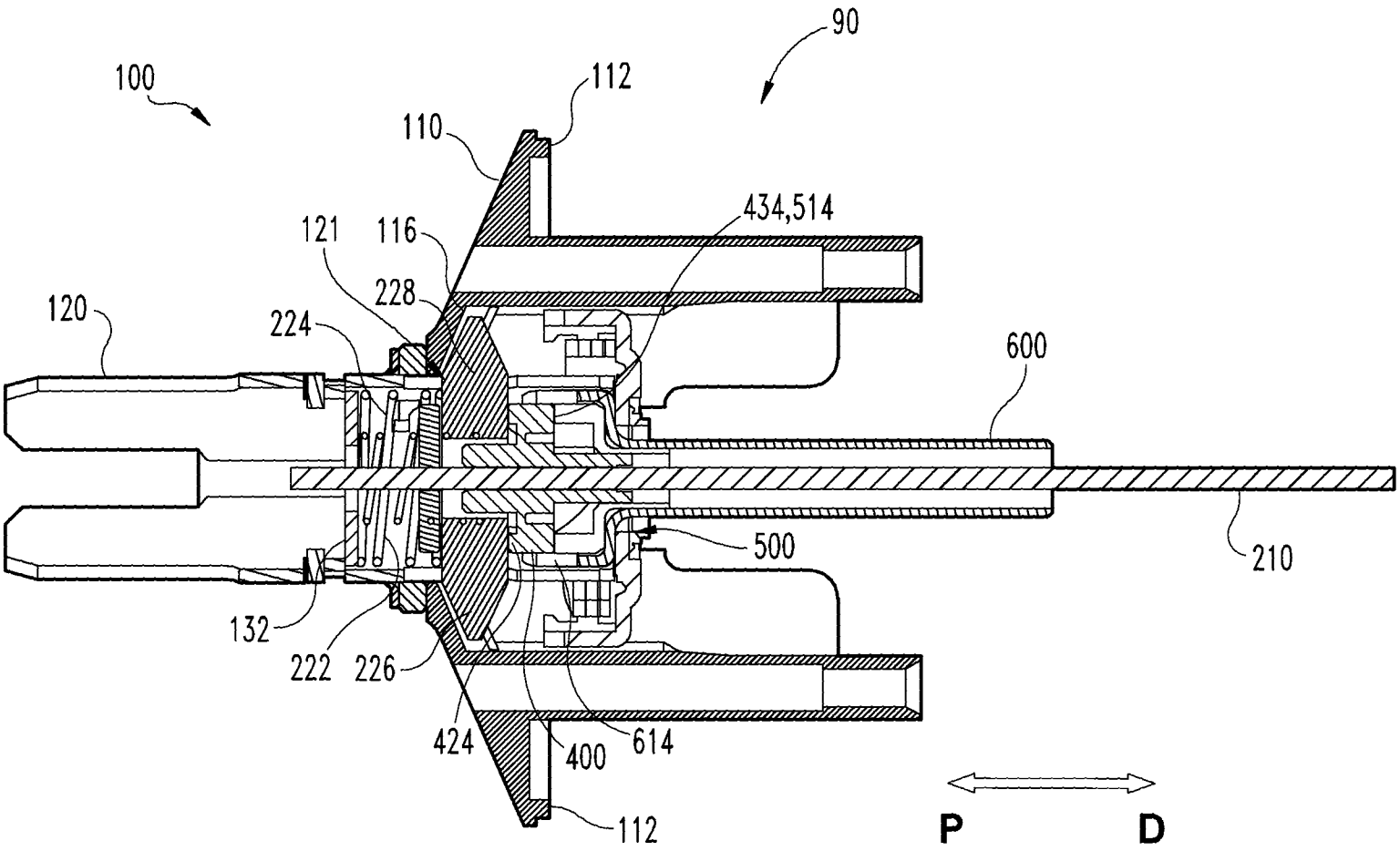
FIG. 11 is a cross-sectional illustration of the tubular lock in a locked state.

With additional reference to FIGS. 10 and 11, when the outer and center assemblies 100, 200 are assembled, the outer spindle 120 extends into the outer housing 110, and the locking bar arms 228 extend radially outward through slots 121 formed in the outer spindle 120. In an unlocked state (FIG. 10), the arms 228 are received in the center spindle slots 614, and the locking bar 226 rotationally couples the outer spindle 120 to the center spindle 600. In this state, rotation of the outer spindle 120 causes rotation of the center spindle 600, which in turn causes the latch bolt 232 to retract. In a locked state (FIG. 11), the arms 228 are received in the housing slots 116, and the locking bar 226 rotationally couples the outer spindle 120 to the outer housing 110 such that the outer spindle 120 is not free to rotate. Additionally, the arms 228 are removed from the center spindle slots 614, thereby rotationally decoupling the outer spindle 120 and the center spindle 600. As such, the center spindle 600 remains free to rotate, and the inner lever 302 remains operable to retract the latch bolt 232. This form of locking by selective engagement between a locking bar and a housing is known in the art (i.e., U.S. Pat. No. 4,470,278 to Hale), and need not be further described herein.

Figure 13:
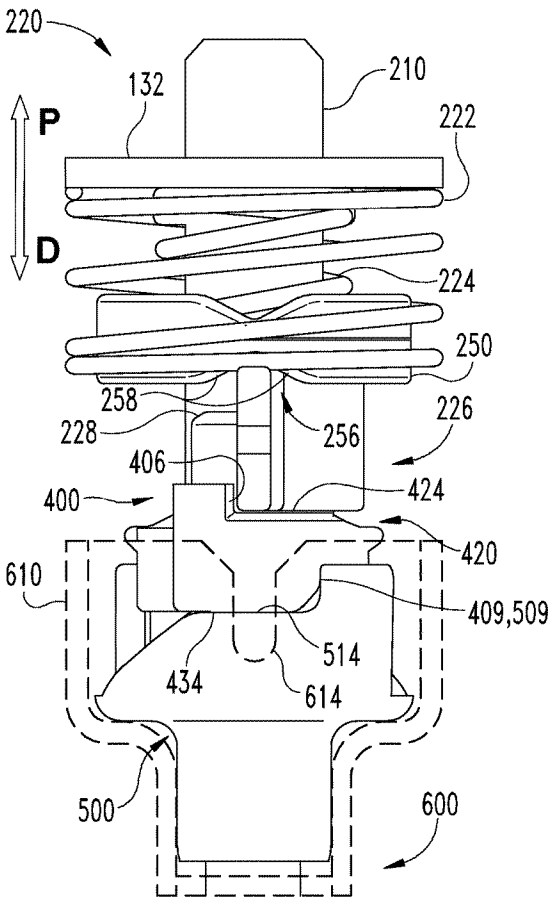
FIG. 13 is an elevational view of the lock control assembly in a locking state.
Figure 12:
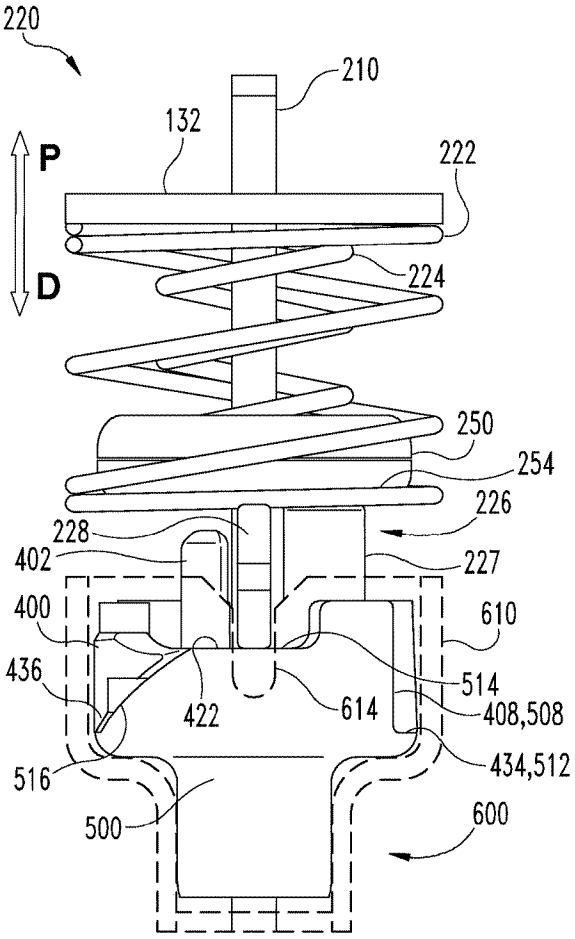
FIG. 12 is an elevational view of one embodiment of a lock control assembly in an unlocking state.

With reference to FIGS. 12 and 13, further details regarding the locked and unlocked states of the illustrative tubular lock 90 will now be described. FIG. 12 depicts the lock control assembly 220 in an unlocking state corresponding to the unlocked state of the tubular lock 90 (FIG. 10). FIG. 13 depicts the lock control assembly 220 corresponding to the locked state of the tubular lock 90 (FIG. 11). In each of the locking and unlocking states, the first spring 222 urges the locking bar 226 into contact with the positioning surfaces 420 of the cam follower 400, and the second spring 224 urges the detent cam 250 into contact with the locking bar 226. The combined forces of the springs 222, 224 also urge the cam follower 400 into contact with the cam 500. More specifically, the springs 222, 224 urge the follower surfaces 430 into engagement with the cam surfaces 510.

With reference to FIGS. 10 and 12, when the tubular lock 90 is in the unlocked state, the lock control assembly 220 is in the unlocking state. In the unlocking state, proximal sides of the locking bar arms 228 are positioned in contact with the detent cam ridge 254, and the distal sides of the locking bar arms 228 are positioned in contact with the positioning surface distal levels 422 and/or the cam surface proximal levels 514. Additionally, the follower surface distal levels 434 are positioned in contact with the cam surface distal levels 512, and the follower surface ramps 436 are positioned adjacent the cam surface ramps 516. The distal biasing force of the springs 222, 224 urges the surfaces of the locking bar 226, the detent cam 250, the cam follower 400, and the cam 500 into contact with one another.

In the unlocking state, each of the first limit stops 408 is positioned adjacent one of the first stop walls 508, and the cam 500 prevents further rotation of the cam follower 400 in the counter-clockwise (CCW) direction (when viewed from the distal side). In FIG. 12, the locking bar 226 is engaged with the center spindle slots 614, and is disengaged from the outer housing slots 116, such that each of the levers 102, 302 is operable to rotate the center spindle 600 to a rotated position in order to retract the latch bolt 232. In the absence of an externally-applied torque, the springs 222, 224 will maintain the lock control assembly 220 in this state.

With specific reference to FIGS. 11 and 13, when the tubular lock 90 is in the locked state, the lock control assembly 220 is in the locking state. In the locking state, proximal sides of the locking bar arms 228 position the detent cam notches 256 between the ramps 258, and the distal sides of the locking bar arms 228 are positioned in contact with the positioning surface proximal levels 424. With the locking bar arms 228 positioned between the ramps 258, the distal biasing force of the second spring 224 resists rotation of the detent cam 250, thereby inhibiting rotation of the driver bar 210. Additionally, the follower surface distal levels 434 are positioned in contact with the cam surface proximal levels 514, and the distal biasing force of the springs 222, 224 urges the surfaces of the locking bar 226, the detent cam 250, the cam follower 400, and the cam 500 into contact with one another.

In the locking state, each of the second limit stops 409 is positioned adjacent to one of the second stop walls 509 such that the cam 500 prevents further clockwise (CW) rotation of the cam follower 400. Additionally, when the cam 500 is rotated in the CCW direction, the second stop walls 509 engage the second limit stops 409, thereby urging the cam follower 400 to rotate CCW. In FIG. 13, the locking bar 226 is disengaged from the center spindle slots 614 and is fully engaged with the outer housing slots 116 such that the inner lever 302, but not the outer lever 102, is operable to rotate the center spindle 600 to a rotated position in order to retract the latch bolt 232. In the absence of an externally-applied torque, the springs 222, 224 will maintain the lock control assembly 220 in this state.

In each of the states depicted in FIGS. 12 and 13, the center spindle 600 is in a home position. As a result, the latch bolt 232 is in an extended or latching position. As such, the state depicted in FIG. 12 may be considered an unlocking latching state, and the state depicted in FIG. 13 may be considered a locking latching state. In order to retract the latch bolt 232, a user may perform an unlatching operation including applying a torque to rotate the center spindle 600 to a rotated position, and subsequently removing the torque. When the torque is applied to the center spindle 600 via the outer lever 102, the unlatching operation may be considered an ingress unlatching operation. When the torque is applied to the center spindle 600 via the inner lever 302, the unlatching operation may be considered an egress unlatching operation. As the center spindle 600 rotates to the rotated position, the stem 620 engages the retractor 234, which in turn retracts the latch bolt 232. When the torque is removed, the center spindle 600 returns to the home position, for example under the influence of the outer torsion spring 134, the inner torsion spring 334, and/or one or more springs in the latch assembly 230. As the center spindle 600 returns to the home position, the latch bolt 232 moves to the extended position.

The illustrated lock control assembly 220 is configured to transition from the locking state (FIG. 13) to the unlocking state (FIG. 12) in a number of different manners. For example, during a manual unlocking operation, a user may rotate the driver bar 210 by rotating the plug 107 or the turn button coupler 307, and the lock control assembly 220 will transition to the unlocking state in response to rotation of the driver bar 210. Additionally, the lock control assembly 220 is configured to perform an automatic unlocking operation or egress release operation, wherein the lock control assembly transitions from the locking state to the unlocking state in response to the above-described egress unlatching operation. Exemplary forms of manual and automatic unlocking operations are described below with reference to FIGS. 12-20.

The angles and longitudinal positions associated with the operational sequences described hereinafter are to be understood as illustrative examples, and may be varied from what is presented to meet the various considerations and design constraints of the complete design of the tubular lock 90. Additionally, while the illustrated tubular lock 90 includes pairs of certain elements (such as the pair of second limit stops 408 and the pair of second stop walls 508), certain descriptions herein need only refer to only one member of the pair. For example, in the interests of ease, convenience, and clarity of description, a description of the locking state may include a characterization that the second limit stop 409 is positioned adjacent the second stop wall 509. It is to be understood, however, that such a description may be utilized to indicate that each of the second limit stops 409 is positioned adjacent one of the second stop walls 509. Furthermore, while the illustrated tubular lock 90 includes pairs of certain elements, in other embodiments, a tubular lock need only include a single one of the elements, or may include three or more of the elements.

Figure 14:
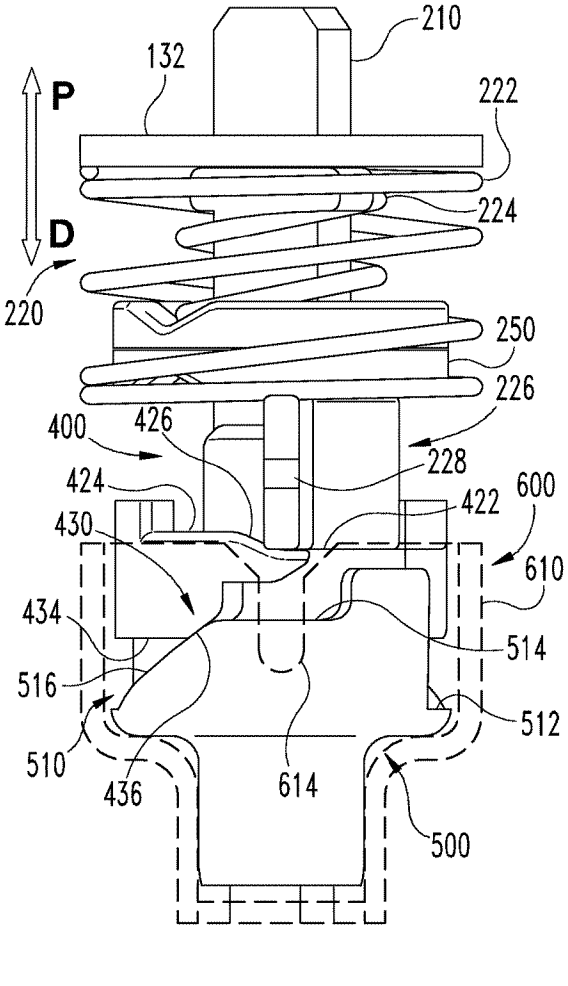
FIG. 14 is an elevational view of the lock control assembly in a transitional state during a manual unlocking operation.

As noted above, the lock control assembly 220 is configured to transition between the locking and unlocking states in response to rotation of the driver bar 210. Thus, a user can manually unlock the tubular lock 90 by rotating either the plug 107 or the turn button 306. FIG. 14 depicts the lock control assembly 220 in a transitional state between the locking state illustrated in FIG. 13 and the unlocking state illustrated in FIG. 12. In the illustrated transitional state, the driver bar 210 has been rotated by an initial rotational angle such as, for example, approximately 40° from the unlocking position depicted in FIG. 12. Rotation of the driver bar 210 causes simultaneous rotation of the cam follower 400 such that the proximal follower surface ramps 436 engage the cam surface ramps 516. As the cam follower 400 continues to rotate, engagement between the ramps 436, 516 urges the cam follower in the proximal direction.

In the transitional state, the follower surface distal levels 434 are longitudinally positioned between the cam surface distal level 512 and the cam surface proximal level 514. The locking bar 226 is positioned in contact with the positioning surface distal level 422, and is also positioned adjacent the positioning surface ramp 426. The distal biasing force provided by the springs 222, 224 maintains contact between the locking bar 226 and the positioning surface 420. In the transitional state, the locking bar 226 is removed from the center spindle slots 614, and may be partially received by the outer housing slots 116. In this state, if the manual external torque is removed from the driver bar 210, the ramps 436, 516 rotate the cam follower 400 to the unlocked position as the springs 222, 224 urge the locking bar 226 and the cam follower 400 in the distal direction.

If the torque continues to be applied to the locking bar 210 when the lock control assembly 220 is in the transitional state, the cam follower 400 continues to rotate. As the cam follower 400 continues to rotate, the locking bar arms 228 travel along the positioning surface ramps 426, which in turn urge the locking bar 226 in the proximal direction. Additionally, engagement between the follower surface ramps 436 and the cam surface ramps 516 urges the cam follower 400 in the proximal direction, thereby moving the locking bar 226 in the proximal direction. Once the cam follower 400 has been rotated by a predetermined angle with respect to the unlocked position such as, for example, approximately 50°, the arms 228 are positioned in contact with the positioning surface proximal levels 424. The follower surface distal level 434 is likewise moved into contact with the cam surface proximal levels 514. Further rotation of the driver bar 210 causes the follower surface distal level 434 to slide along the cam surface proximal level 514 until the lock control assembly 220 reaches the locking state depicted in FIG. 13.

Figure 15:
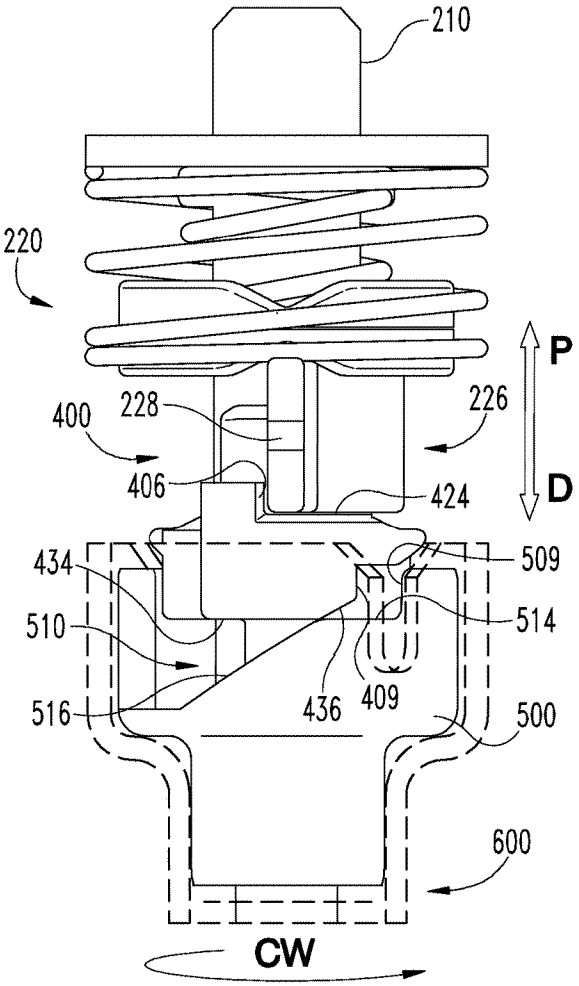
FIGS. 15-17 depict the lock control assembly at various transitional states during a first automatic unlocking operation.
Figure 17:
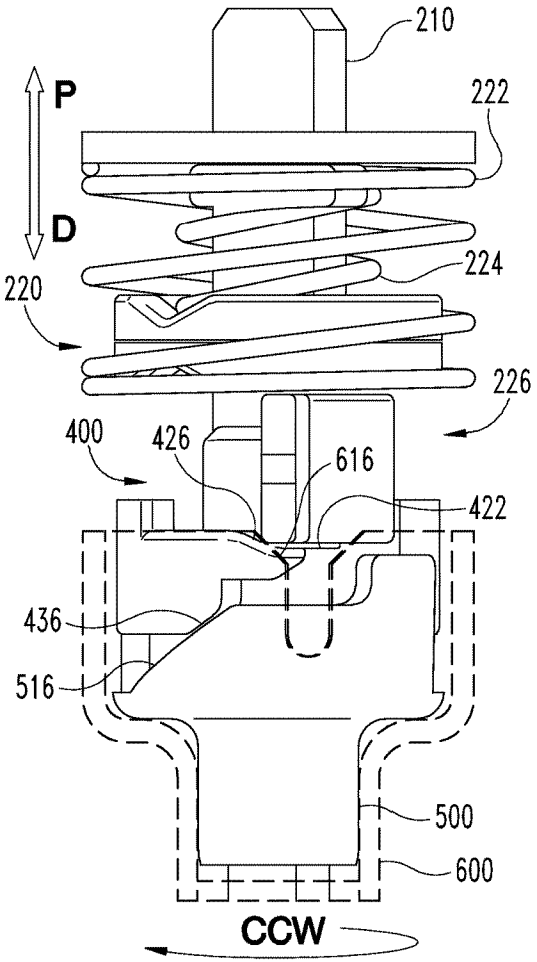
Figure 16:
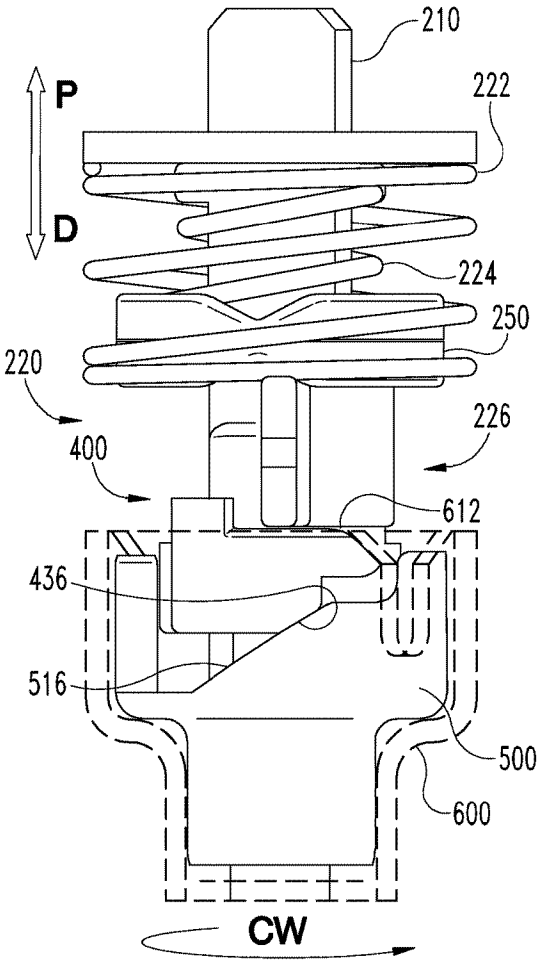
Figure 19:
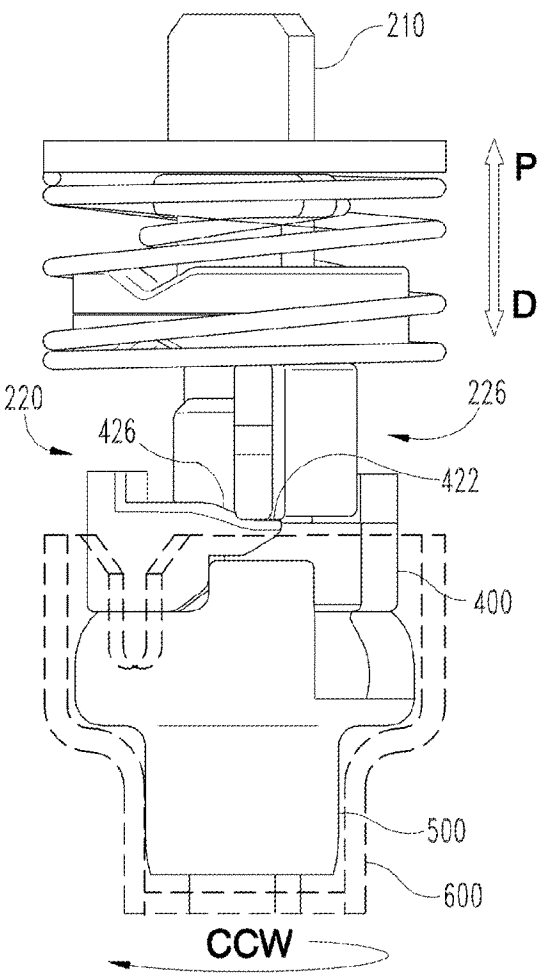
FIG. 18-20 depict the lock control assembly at various transitional states during a second automatic unlocking operation.
Figure 18:
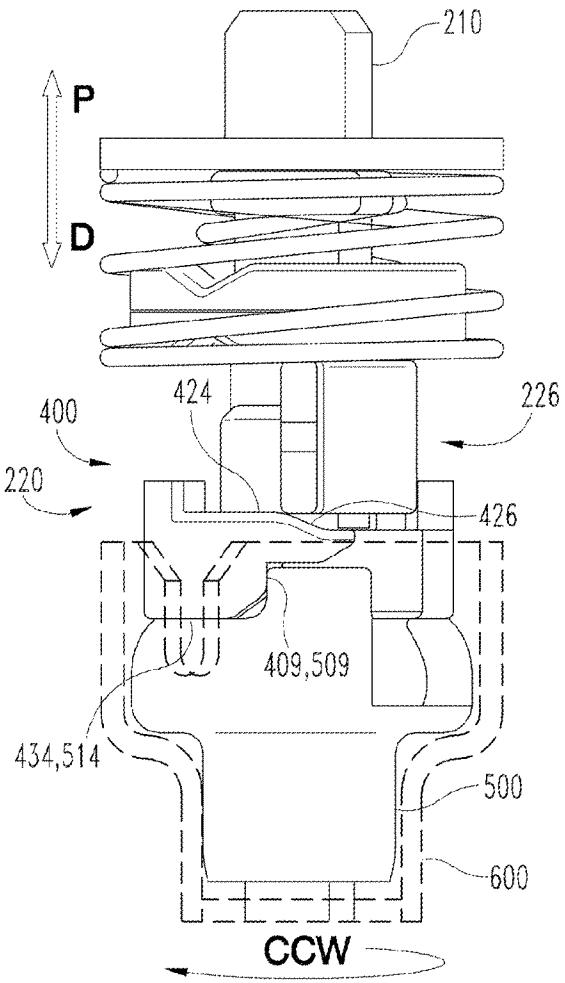
Figure 20:
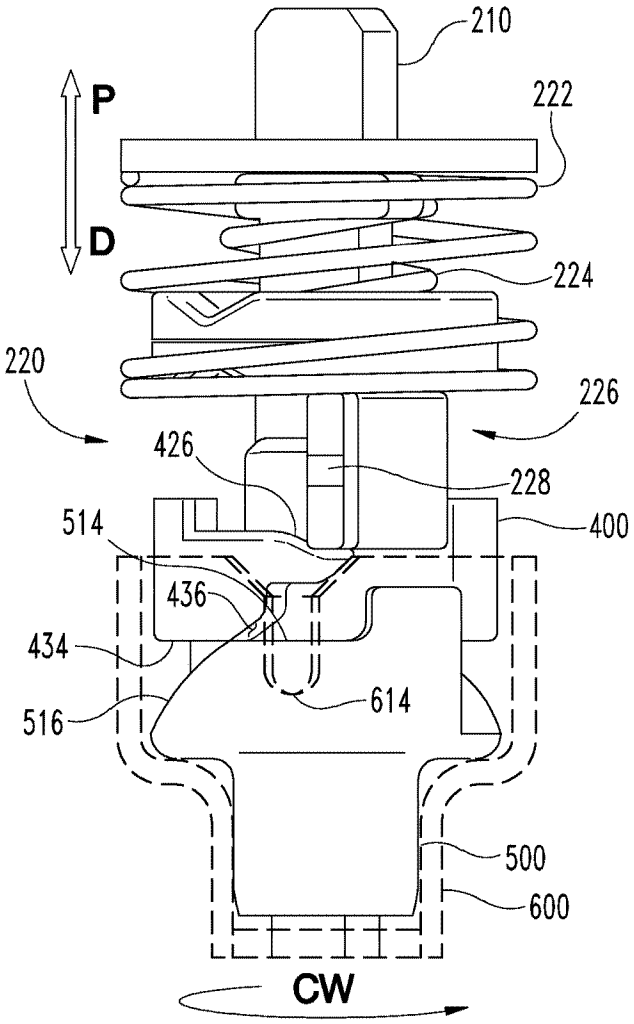

The lock control assembly 220 is additionally configured to perform an egress release operation when the tubular lock 90 is operated by the inner lever 302. In other words, the tubular lock 90 automatically unlocks in response to the egress unlatching operation. In the illustrated embodiment, the lock control assembly 220 is configured to automatically transition to the unlocking state in response to each of a CW rotation and a CCW rotation of the outer lever 302. Exemplary forms of egress release operations are illustrated in FIGS. 15-20. More specifically, FIGS. 15-17 illustrate an operational sequence for egress release when the inner lever 302 is rotated in a CW direction, and FIGS. 18-20 illustrate an operational sequence for egress release when the inner lever 302 is rotated in a CCW direction. In each of the operational sequences, the lock control assembly 220 begins in the locking latching state illustrated in FIG. 13, and ends in the unlocking latching state illustrated in FIG. 12.

With specific reference to FIGS. 15-17, the lock control assembly 220 is illustrated in various stages of an egress release operation during a CW rotation of the inner lever 302 to retract the latch bolt 232. As noted above, the inner lever 302 is rotationally coupled with the center spindle 600 such that a change in angular position of the inner lever 302 causes an approximately equal change to the angular position of the center spindle 600.

When the lock control assembly 220 is in the locking state (FIG. 13) and a CW torque is applied to the inner lever 302, the center spindle 600 and the cam 500 rotate CW. The cam follower 400 retains its rotational position, for example, due to engagement between the locking bar arms 228 and the stops 406. With the driver bar 210 is rotationally coupled to the cam follower 400, it also retains its rotational position as the center spindle 600 is rotated CW.

As the cam 500 rotates, the follower surface distal level 434 slides along the cam surface proximal level 514, and each of the second stop walls 509 moves away from the corresponding second limit stop 409. Once the cam 500 and center spindle 600 have been rotated through a first CW angle such as, for example, approximately 35°, the lock control assembly 220 comprises a first CW transitional state, as illustrated in FIG. 15. In the first CW transitional state, the follower surface ramp 436 is positioned adjacent the cam surface ramp 516, and the locking bar 226 remains engaged with the positioning surface proximal level 424. In this state, additional CW rotation of the center spindle 600 and the cam 500 will cause the follower surface ramp 436 to engage the cam surface ramp 516.

As the CW torque continues to be applied to the inner lever 302, the center spindle 600 rotates to a second CW rotated position, the cam surface ramps 516 become aligned with the follower surface ramps 436, and the distal biasing force of the springs 222, 224 urge the ramps 436, 516 into engagement with one another. With the ramps 436, 516 engaged with one another, the lock control assembly is in a second CW rotated state, as depicted in FIG. 16. In this state, the distal biasing forces of the springs 222, 224 cause the cam follower 400 to move in the distal direction, and the engagement between the ramps 436, 516 causes the cam follower 400 to rotate in the CCW direction. As the cam follower 400 moves distally, the locking bar 226 engages the center spindle proximal end surface 612. In this state, the locking bar 226 is partially engaged with the outer housing slots 116 such that the outer spindle 120 is still rotationally coupled to the outer housing 110. With the center spindle 600 in this position, the latch bolt 232 may be partially or fully retracted. Should the center spindle 600 be further rotated in the CW direction, the locking bar arms 228 will slide along the proximal end surface such that the positions of the locking bar 226 and the cam follower 400 are not substantially or materially altered.

When the CW torque is removed, the center spindle 600 rotates in the CCW direction due to a biasing force provided by the inner torsion spring 332 and/or springs in the latch assembly 230. As the center spindle 600 and the cam 500 rotate CCW, the cam 500 urges the cam follower 400 and driver bar 210 in the CCW direction, and the locking bar 226 slides along the positioning surface proximal level and the positioning surface ramp. When the center spindle 600 has been rotated to a third CW position, the lock control assembly 220 is in a third CW transitional state, as illustrated in FIG. 17. In the third CW transitional state, the cam follower 400 is rotationally offset from its unlocking position by a predetermined angle (such as about) 30°, and the locking bar 226 is positioned in contact with the positioning surface distal level.

In the illustrated third CW transitional state, the center spindle 600 is slightly angularly offset from the home position (for example by about 10°), and each of the locking bar arms 228 is aligned with a chamfer 616 of one of the center spindle slots 614. As such, the distal biasing force of the springs 222, 224 urges the locking bar 226 into engagement with the chamfers 616, and the engagement may assist in returning the center spindle 600 to the home position. In embodiments in which the center spindle slots 614 do not comprise chamfers 616, the center spindle 600 may be in the home position when the lock control assembly 220 is in the third CW transitional state, wherein the locking bar arms 228 are aligned with the longitudinally extending center spindle slots 614.

With the locking bar arms 228 aligned with the center spindle slots 614, the distal biasing force of the springs 222, 224 cause the locking bar 226 and the cam follower 400 to move in the distal direction, and the engagement between the ramps 436, 516 causes the cam follower 400 to rotate in the CCW direction. When the locking bar arms 228 are received in the center spindle slots 614, the cam follower 400 is in the unlocking position, and the lock control assembly 220 is in the unlocking latching state depicted in FIG. 12.

With reference to FIGS. 18-20, the lock control assembly 220 is illustrated in various stages of an egress release function during a CCW rotation of the inner lever 302. When a CCW torque is applied to the inner lever 302, the center spindle 600 rotates CCW. When the center spindle 600 and the cam 500 have been rotated through a first CCW angle from the home position (such as approximately 35°) to a first CCW rotated position, the lock control assembly 220 transitions from the locking latching state illustrated in FIG. 13 to the first CCW transitional state illustrated in FIG. 18. As noted above, when the lock control assembly 220 is in the locking state (FIG. 13), the second limit stops 409 of the cam follower 400 are positioned adjacent the second stop walls 509 of the cam 500. Accordingly, CCW rotation of the cam 500 causes the cam follower 400 to rotate with the cam 500 such that the cam follower 400 is offset from the locking position by an angle corresponding to the first CCW angle.

In the first CCW transitional state, the locking bar 226 is engaged with the positioning surface proximal level 424, and is positioned adjacent the positioning surface ramp 426. Thus, additional CCW rotation of the center spindle 600 causes the locking bar 226 to slide out of contact with the positioning surface proximal level 424 and into engagement with the positioning surface ramp 426. Additionally, the follower surface distal level 434 remains in contact with the cam surface proximal level 514, and the locking bar 226 remains engaged with the outer housing slots 116.

As the CCW torque continues to be applied, the center spindle 600 and cam 500 rotate to a second CCW position. As the center spindle 600 and the cam 500 rotate, the cam 500 rotates the cam follower 400 (and thus the locking bar 210) by a corresponding CCW angle such that the lock control assembly 220 is positioned in the second CCW transitional state depicted in FIG. 19. In the second CCW position, the center spindle 600 is offset from the home position by a second CCW angle such as, for example, approximately 45°, and the cam follower 400 is offset from its locking position by a corresponding angle. As the cam follower 400 rotates CCW, the locking bar 226 travels along the positioning surface ramp 426 and into engagement with the positioning surface distal level 422. In this position, the locking bar 226 remains partially engaged with the outer housing the slots 116 such that the outer spindle 120 is still rotationally coupled to the outer housing 110.

When the CCW torque is removed, the center spindle 600 rotates in the CW direction (for example, due to a biasing force provided by the inner torsion spring 332 and/or springs in the latch assembly 230) to a third CCW position, such that the lock control assembly 220 is positioned in the third CCW transitional state depicted in FIG. 20. The third CCW position may be offset from the home position by a third CCW angle such as, for example, approximately 10°. As the center spindle 600 and the cam 500 rotate CW, the cam follower 400 retains its longitudinal position as the follower surface distal level 434 slides along the cam surface proximal level 514. Additionally, engagement between the locking bar arms 228 and the positioning surface ramp 426 inhibits rotation of the cam follower 400, thereby maintaining the rotational position of the cam follower 400.

In the third CCW transitional state, the cam follower 400 is rotationally offset from its locking position by a predetermined angle (such as about 30°), the locking bar 226 is in contact with the positioning surface distal level, and the distal end of the follower surface ramp 436 is positioned adjacent the proximal end of the cam surface ramp 516. Thus, as the center spindle 600 and the cam 500 continue to rotate in the CW direction toward the home position, the follower surface ramp 436 slides into contact with the cam surface ramp 516.

In the illustrated third CCW transitional state, the center spindle 600 is slightly angularly offset from the home position (for example by about 10°), and each of the locking bar arms 228 is aligned with a chamfer 616 on one of the center spindle slots 614. As such, the distal biasing force of the springs 222, 224 urges the locking bar 226 into engagement with the chamfers 616, and the engagement may assist in returning the center spindle 600 to the home position. In embodiments in which the center spindle slots 614 do not comprise chamfers 616, the center spindle 600 may be positioned in the home position when the lock control assembly 220 is in the third CCW transitional state, such that the locking bar arms 228 are aligned with the longitudinally extending center spindle slots 614.

With the locking bar arms 228 aligned with the center spindle slots 614, the distal biasing force of the springs 222, 224 cause the locking bar 226 and the cam follower 400 to move in the distal direction, and the engagement between the ramps 436, 516 causes the cam follower 400 to rotate in the CCW direction. When the locking bar arms 228 are received in the center spindle slots 614, the cam follower 400 is positioned in the unlocking position, and the lock control assembly 220 is positioned in the unlocking latching state depicted in FIG. 12.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a center spindle extending along a longitudinal axis in a proximal direction and a distal direction, the center spindle comprising a cup including a longitudinal center spindle slot;

an outer spindle comprising a longitudinal outer spindle slot; and a lock control assembly configured to selectively couple the center spindle and the outer spindle, the lock control assembly comprising:

a cam positioned in the cup and rotationally coupled to the center spindle, a proximal side of the cam including a cam surface comprising a cam surface proximal level and a cam surface ramp extending distally from the cam surface proximal level;

a driver bar extending through the center spindle and the cam, wherein the driver bar is rotatable with respect to the center spindle and the cam;

a cam follower rotationally coupled with the driver bar and longitudinally movable with respect to the driver bar, a distal side of the cam follower including a follower surface engaged with the cam surface, the follower surface including a follower surface distal level and a follower surface ramp extending proximally from the follower surface distal level;

a locking bar positioned adjacent a proximal side of the cam follower, the locking bar including an arm extending through the outer spindle slot, wherein the locking bar is longitudinally movable along the outer spindle slot between an unlocking position in which the arm is received in the center spindle slot and a locking position in which the arm is not received in the center spindle slot; and a biasing element distally urging the locking bar into contact with the proximal side of the cam follower;

wherein the lock control assembly is operable in a locking state and an unlocking state;

wherein, in the locking state, the follower surface distal level is in contact with the cam surface proximal level, the locking bar is in the locking position, and the outer spindle is rotationally decoupled from the center spindle;

wherein, in the unlocking state, the follower surface distal level is positioned distally of the cam surface proximal level, the follower surface ramp is positioned adjacent the cam surface ramp, the locking bar is in the unlocking position, and the outer spindle is rotationally coupled with the center spindle;

wherein the proximal side of the cam follower includes a positioning surface comprising a positioning surface proximal level and a positioning surface ramp extending distally from the positioning surface proximal level;

wherein the cam follower further comprises a proximally extending stop positioned adjacent the positioning surface proximal level; and wherein, in the locking state, the locking bar is positioned in contact with the positioning surface proximal level, and the stop is positioned adjacent the arm.

2. The apparatus of claim 1, wherein the positioning surface further comprises a positioning surface distal level;

wherein the positioning surface ramp extends proximally from the positioning surface distal level; and wherein, in the unlocking state, the locking bar is in contact with the positioning surface distal level.

3. The apparatus of claim 1, wherein the cam surface further comprises a cam surface distal level, the cam surface ramp extending proximally from the cam surface distal level; and wherein, in the unlocking state, the cam surface distal level is positioned in contact with the follower surface distal level.

4. The apparatus of claim 3, wherein the cam further comprises a stop wall extending proximally from the cam surface proximal level;

wherein the cam follower further comprises a limit stop extending proximally from the follower surface ramp; and wherein, in the locking state, the stop wall is positioned adjacent the limit stop.

5. The apparatus of claim 4, wherein the cam follower further comprises a follower surface proximal level connected to the limit stop; and wherein the follower surface further comprises a secondary follower surface ramp extending proximally from the follower surface proximal level.

6. The apparatus of claim 4, wherein each of the stop wall and the limit stop is arranged substantially parallel to the longitudinal axis, wherein each of the cam surface distal level, the cam surface proximal level, and the follower surface distal level is arranged substantially perpendicular to the longitudinal axis, and wherein each of the cam surface ramp and the follower surface ramp is offset from the longitudinal axis by an oblique angle.

7. The apparatus of claim 3, wherein the cam further comprises a second stop wall extending proximally from the cam surface distal level;

wherein the cam follower further comprises a second limit stop extending proximally from the follower surface distal level; and wherein, in the unlocking state, the second stop wall is positioned adjacent the second limit stop.

8. The apparatus of claim 1, wherein the cam is separable from the center spindle.

9. An apparatus, comprising:

a center spindle extending along a longitudinal axis in a proximal direction and a distal direction, the center spindle comprising a cup including a longitudinal center spindle slot;

an outer spindle comprising a longitudinal outer spindle slot; and a lock control assembly configured to selectively couple the center spindle and the outer spindle, the lock control assembly comprising:

a cam positioned in the cup and rotationally coupled to the center spindle, a proximal side of the cam including a cam surface comprising a cam surface proximal level and a cam surface ramp extending distally from the cam surface proximal level;

a driver bar extending through the center spindle and the cam, wherein the driver bar is rotatable with respect to the center spindle and the cam;

a cam follower rotationally coupled with the driver bar and longitudinally movable with respect to the driver bar, a distal side of the cam follower including a follower surface engaged with the cam surface, the follower surface including a follower surface distal level and a follower surface ramp extending proximally from the follower surface distal level;

a locking bar positioned adjacent a proximal side of the cam follower, the locking bar including an arm extending through the outer spindle slot, wherein the locking bar is longitudinally movable along the outer spindle slot between an unlocking position in which the arm is received in the center spindle slot and a locking position in which the arm is not received in the center spindle slot; and a biasing element distally urging the locking bar into contact with the proximal side of the cam follower;

wherein the lock control assembly is operable in a locking state and an unlocking state;

wherein, in the locking state, the follower surface distal level is in contact with the cam surface proximal level, the locking bar is in the locking position, and the outer spindle is rotationally decoupled from the center spindle;

wherein, in the unlocking state, the follower surface distal level is positioned distally of the cam surface proximal level, the follower surface ramp is positioned adjacent the cam surface ramp, the locking bar is in the unlocking position, and the outer spindle is rotationally coupled with the center spindle; and wherein the lock control assembly further comprises:

a detent cam positioned adjacent a proximal side of the locking bar, the detent cam including a detent cam slot, a ridge, and a notch formed in the ridge; and a second biasing element distally urging the detent cam into contact with the locking bar; and wherein the driver bar extends through the detent cam slot.

10. The apparatus of claim 9, wherein, in the locking state, the arm is received in the notch; and wherein, in the unlocking state, the arm is positioned in contact with the ridge.

11. A method, comprising:

forming a lock control assembly, the forming comprising:

rotationally coupling a cam to a center spindle defining a longitudinal axis extending in a proximal direction and a distal direction, the center spindle comprising a stem and a cup including a slot, a proximal side of the cam including a first stop wall, a second stop wall, and a cam surface extending between the first and second stop walls, the cam surface comprising a cam surface distal level positioned adjacent the first stop wall, a cam surface proximal level positioned adjacent the second stop wall, and a cam surface ramp connecting the cam surface proximal level and the cam surface distal level;

passing a driver bar through the cam and the center spindle;

rotationally coupling a cam follower to the driver bar adjacent the proximal side of the cam, a distal side of the cam follower comprising a first limit stop, a second limit stop, and a follower surface comprising a follower surface distal level positioned adjacent the first limit stop and a follower surface ramp connecting the follower surface distal level and the second limit stop;

positioning a locking bar adjacent a proximal side of the cam follower;

engaging a first biasing element with a proximal side of the locking bar, the first biasing element urging the locking bar in the distal direction;

positioning a detent cam adjacent a proximal side of the locking bar, the detent cam including a detent cam slot, a ridge, and a notch formed in the ridge, wherein positioning the detent cam includes inserting the driver bar through the detent cam slot;

engaging a second biasing element with a proximal side of the detent cam, the second biasing element urging the detent cam in the distal direction and into contact with the locking bar; and providing a distal biasing force to the locking bar, the distal biasing force urging the locking bar into contact with the proximal side of the cam follower and urging the follower surface into contact with the cam surface, wherein the distal biasing force is provided by the first biasing element and the second biasing element.

12. The method of claim 11, further comprising:

setting the lock control assembly in an unlocking state, the setting comprising:

placing the cam follower in an unlocking position wherein the first limit stop is positioned adjacent the first stop wall, the follower surface distal level is positioned in contact with the cam surface distal level, the follower surface ramp is positioned adjacent the cam surface ramp, and the cam follower is at least partially received in the cup, wherein the unlocking position comprises a first rotational position and a first longitudinal position; and urging, with the distal biasing force, the locking bar into the slot.

13. The method of claim 12, further comprising:

transitioning the lock control assembly from the unlocking state to a locking state, the transitioning comprising:

rotating the cam follower from the first rotational position to a second rotational position, thereby causing the cam surface ramp to engage the follower surface ramp, engagement between the cam surface ramp and the follower surface ramp urging the cam follower in the proximal direction to a second longitudinal position, wherein, in the second rotational position, the follower surface distal level is in contact with the cam surface proximal level; and rotating the cam follower from the second rotational position to a third rotational position, thereby sliding the follower surface distal level along the cam surface proximal level and placing the cam follower in a locking position comprising the third rotational position and the second longitudinal position; and wherein, in the locking state, the second stop wall is positioned adjacent the second limit stop and the locking bar is removed from the slot.

14. The method of claim 13, further comprising:

performing an unlocking operation, the performing the unlocking operation comprising:

rotating the cam follower from the third rotational position to the second rotational position, thereby sliding the follower surface distal level along the cam surface proximal level;

rotating the cam follower from the second rotational position to the first rotational position; and while rotating the cam follower from the second rotational position to the first rotational position, urging, with the distal biasing force, the locking bar in the distal direction, thereby urging the cam follower toward the first longitudinal position.

15. The method of claim 13, further comprising:

performing an unlocking operation, the performing the unlocking operation comprising:

rotating the center spindle in a first rotational direction, thereby rotating the cam in the first rotational direction from a home position to a rotated position, wherein the second stop wall moves away from the second limit stop as the cam rotates in the first rotational direction;

while rotating the cam in the first rotational direction, sliding the follower surface distal level along the cam surface distal level, and subsequently engaging the follower surface ramp with the cam surface ramp;

with the follower surface ramp engaged with the cam surface ramp, urging, with the distal biasing force, the locking bar into contact with a proximal end surface of the cup, wherein engagement between the follower surface ramp and the cam surface ramp urges the cam follower in a second rotational direction as the locking bar travels in the distal direction;

with the locking bar in contact with the proximal end surface of the cup, rotating the center spindle in the second rotational direction, thereby aligning the slot with the locking bar and rotating the cam in the second rotational direction from the rotated position to the home position, wherein engagement between the follower surface ramp and the cam surface ramp rotates the cam follower in the second rotational direction as the cam rotates in the second rotational direction; and with the locking bar aligned with the slot, urging, with the distal biasing force, the locking bar into the slot, wherein engagement between the follower surface ramp and the cam surface ramp urges the cam follower toward the unlocking position as the locking bar travels in the distal direction.

16. The method of claim 13, wherein the proximal side of the cam follower comprises a positioning surface including a positioning surface proximal level, a positioning surface distal level, and a positioning surface ramp connecting the positioning surface proximal level and the positioning surface distal level;

wherein, in the locking state, the locking bar is in contact with the positioning surface proximal level, and the center spindle and the cam are in a home position;

the method further comprising performing an unlocking operation, the performing the unlocking operation comprising:

rotating the center spindle and the cam in a first rotational direction from a home position to a rotated position, wherein the second stop wall engages the second limit stop as the cam rotates in the first rotational direction, thereby rotating the cam follower with the cam;

while rotating the cam follower in the first rotational direction, sliding the locking bar along the positioning surface proximal level, and subsequently into engagement with the positioning surface ramp;

with the locking bar engaged with the positioning surface ramp, rotating the center spindle and the cam in a second rotational direction from the rotated position to the home position, thereby aligning the slot with the locking bar, wherein engagement between the locking bar and the positioning surface ramp inhibits the cam follower from rotating in the second rotational direction;

while rotating the cam in the second rotational direction, sliding the follower surface distal level along the cam surface proximal level, and subsequently engaging the follower surface ramp with the cam surface ramp; and with the locking bar aligned with the slot and the follower surface ramp engaged with the cam surface ramp, urging, with the distal biasing force, the locking bar into the slot, wherein engagement between the follower surface ramp and the cam surface ramp urges the cam follower toward the unlocking position as the locking bar travels into the slot.

17. A system, comprising:

an outer spindle including a pair of outer spindle slots extending longitudinally in a proximal direction and a distal direction;

a center spindle comprising a cup including a pair of center spindle slots, and a stem extending distally from the cup; and a lock control assembly comprising:

a cam seated in the cup and rotationally coupled to the center spindle, a proximal side of the cam including a pair of first stop walls, a pair of second stop walls, and a pair of cam surfaces, each of the cam surfaces comprising a cam surface distal level positioned adjacent one of the first stop walls, a cam surface proximal level positioned adjacent one of the second stop walls, and a cam surface ramp connecting the cam surface proximal level and the cam surface distal level;

a driver bar extending through the center spindle and the cam, wherein the driver bar is rotatable with respect to the center spindle and the cam;

a cam follower comprising a cam follower distal side, a cam follower proximal side, and a cam follower slot through which the driver bar extends;

wherein the cam follower distal side comprises a pair of first limit stops, a pair of second limit stops, and a pair of follower surfaces, each of the follower surfaces comprising a follower surface distal level positioned adjacent one of the first limit stops and a follower surface ramp extending proximally from the follower surface distal level to one of the second limit stops; and wherein the cam follower proximal side comprises a pair of positioning surfaces, each positioning surface comprising a positioning surface distal level, a positioning surface proximal level, and a positioning surface ramp connecting the positioning surface distal level and the positioning surface proximal level;

a longitudinally movable locking bar positioned adjacent the cam follower proximal side, the locking bar including a pair of arms, each of the arms extending through one of the outer spindle slots;

a biasing element urging the locking bar and the cam follower in the distal direction, thereby urging each of the arms into contact with one of the positioning surfaces, and urging each of the follower surfaces into contact with one of the cam surfaces;

a detent cam positioned adjacent a proximal side of the locking bar, the detent cam comprising a ridge and a pair of notches formed in the ridge; and a second biasing element urging the detent cam into contact with the locking bar;

wherein the lock control assembly has an unlocking state and a locking state;

wherein, in the unlocking state, each of the follower surface distal levels is positioned in contact with one of the cam surface distal levels, each of the first stop walls is positioned adjacent one of the first limit stops, each of the follower surface ramps is positioned adjacent one of the cam surface ramps, and each of the arms is received in a corresponding one of the center spindle slots and is in contact with the ridge; and wherein, in the locking state, each of the follower surface distal levels is in contact with one of the cam surface proximal levels, each of the second stop walls is positioned adjacent a corresponding one of the second limit stops, each of the arms is in contact with one of the positioning surface proximal levels, and each of the arms is removed from the corresponding one of the center spindle slots and is received in one of the notches.

18. The system of claim 17, further comprising a stop washer coupled to the outer spindle;

wherein the biasing element comprises a first compression spring positioned between the stop washer and the locking bar;

wherein the second biasing element comprises a second compression spring positioned between the stop washer and the detent cam; and wherein the first and second compression springs are concentric.

19. The system of claim 17, wherein the center spindle is rotatable in a first rotational direction from the home position to a rotated position;

the system further comprising a rotational biasing element urging the center spindle in a second rotational direction and toward a home position; and wherein the lock control assembly is configured to transition from the locked state to the unlocked state in response to rotation of the center spindle from the home position to the rotated position and subsequently to the home position.

20. The system of claim 19, wherein the first rotational direction is a direction which moves each of the second stop walls away from the corresponding one of the second limit stops;

wherein, with the center spindle in the rotated position, each of the follower surface ramps is positioned in contact with one of the cam surface ramps, and each of the arms is in contact with a proximal end surface of the cup;

wherein engagement between the follower surface ramps and the cam surface ramps is configured to urge the cam follower in the second rotational direction in response to rotation of the center spindle from the rotated position toward the home position; and wherein, with the center spindle in the home position, each of center spindle slots is aligned with one of the arms.

21. The system of claim 19, wherein the first rotational direction is a direction which moves each of the second stop walls toward the corresponding one of the limit stops;

wherein, with the center spindle in the rotated position, each of the follower surface distal levels is positioned in contact with one of the cam surface proximal levels, and each of arms is engaged with one of the positioning surface ramps;

wherein engagement between the arms and the positioning surface ramps is configured to resist rotation of the cam follower in response to rotation of the center spindle from the rotated position toward the home position; and wherein, with the center spindle in the home position, each of the arms is aligned with one of the center spindle slots.

22. The system of claim 17, wherein the cam further comprises an opening through which the driver bar extends;

the cam follower further comprising a substantially cylindrical post extending distally from the cam follower distal side, the slot extending through the post; and wherein the post is received in the opening.

23. The system of claim 17, further comprising an outer housing including a distal side having a pair of outer housing slots;

wherein the outer spindle is rotatably coupled to the outer housing; and wherein, in the locking state, each of the arms is received in one of the outer housing slots.

24. The system of claim 23, further comprising:

an outer actuator coupled to the outer spindle;

a lock cylinder mounted in the outer actuator, the lock cylinder including a plug connected with a proximal end of the driver bar;

a latch mechanism including a retractor and a latch bolt configured to retract in response to rotation of the retractor, wherein the retractor is coupled to the stem;

an inner spindle coupled to the center spindle;

an inner actuator coupled to the inner spindle; and a turn piece coupled to a distal end of the driver bar, wherein the turn piece is configured to rotate the driver bar in response to a manual input from a user.

25. A system, comprising:

an outer spindle including a pair of outer spindle slots extending longitudinally in a proximal direction and a distal direction;

a center spindle comprising a cup including a pair of center spindle slots, and a stem extending distally from the cup; and a lock control assembly comprising:

a cam seated in the cup and rotationally coupled to the center spindle, a proximal side of the cam including a pair of first stop walls, a pair of second stop walls, and a pair of cam surfaces, each of the cam surfaces comprising a cam surface distal level positioned adjacent one of the first stop walls, a cam surface proximal level positioned adjacent one of the second stop walls, and a cam surface ramp connecting the cam surface proximal level and the cam surface distal level;

a driver bar extending through the center spindle and the cam, wherein the driver bar is rotatable with respect to the center spindle and the cam;

a cam follower comprising a cam follower distal side, a cam follower proximal side, and a cam follower slot through which the driver bar extends;

wherein the cam follower distal side comprises a pair of first limit stops, a pair of second limit stops, and a pair of follower surfaces, each of the follower surfaces comprising a follower surface distal level positioned adjacent one of the first limit stops and a follower surface ramp extending proximally from the follower surface distal level to one of the second limit stops; and wherein the cam follower proximal side comprises a pair of positioning surfaces, each positioning surface comprising a positioning surface distal level, a positioning surface proximal level, and a positioning surface ramp connecting the positioning surface distal level and the positioning surface proximal level;

a longitudinally movable locking bar positioned adjacent the cam follower proximal side, the locking bar including a pair of arms, each of the arms extending through one of the outer spindle slots; and wherein the lock control assembly has an unlocking state and a locking state;

wherein, in the unlocking state, each of the follower surface distal levels is positioned in contact with one of the cam surface distal levels, each of the first stop walls is positioned adjacent one of the first limit stops, each of the follower surface ramps is positioned adjacent one of the cam surface ramps, and each of the arms is received in a corresponding one of the center spindle slots;

wherein, in the locking state, each of the follower surface distal levels is in contact with one of the cam surface proximal levels, each of the second stop walls is positioned adjacent a corresponding one of the second limit stops, each of the arms is in contact with one of the positioning surface proximal levels, and each of the arms is removed from the corresponding one of the center spindle slots;

wherein the locking bar further comprises an arcuate central portion connecting the pair of arms;

wherein the cam follower further comprises a substantially cylindrical post extending proximally from the cam follower proximal side, the slot extending through the post; and wherein the arcuate central portion receives a portion of the post.

* * * * *